US007951214B2

(12) United States Patent
Menrik et al.

(10) Patent No.: US 7,951,214 B2
(45) Date of Patent: May 31, 2011

(54) FILTER CLEANING SYSTEM FOR A VACUUM CLEANER

(75) Inventors: Linda Menrik, Hägersten (SE); Anna-Karin Gray, Stockholm (SE); Finn Lofnes, Coye la Forêt (FR); Håkan Miefalk, Järfälla (SE); Mattias Jansson, Pordenone (IT); Anna-Karin Trydegård, Stockholm (SE); Mathias Belin, Saltsjö-Boo (SE); Henrik Holm, Stockholm (SE); Lars Mennborg, Vikingstad (SE)

(73) Assignee: AB Electrolux, Stockholm (SE)

( * ) Notice: Subject to any disclaimer, the term of this patent is extended or adjusted under 35 U.S.C. 154(b) by 878 days.

(21) Appl. No.: 10/567,463

(22) PCT Filed: Nov. 26, 2004

(86) PCT No.: PCT/SE2004/001756

§ 371 (c)(1),
(2), (4) Date: Dec. 5, 2006

(87) PCT Pub. No.: WO2005/053497

PCT Pub. Date: Jun. 16, 2005

(65) Prior Publication Data

US 2007/0125049 A1 Jun. 7, 2007

(30) Foreign Application Priority Data

Dec. 4, 2003 (SE) ..... 0303277
May 6, 2004 (SE) ..... 0401183

(51) Int. Cl.
*B01D 39/00* (2006.01)

(52) U.S. Cl. ..... 55/288; 55/301; 55/302; 55/459; 55/484; 55/DIG. 3; 95/268; 95/269; 95/271; 95/280

(58) Field of Classification Search ..... 55/324, 55/337, DIG. 3, 434–465, 288, 301, 302, 55/484; 96/380–388; 95/268–269, 271, 95/280

See application file for complete search history.

(56) References Cited

U.S. PATENT DOCUMENTS

| | | | | |
|---|---|---|---|---|
| 2,404,358 | A | 7/1946 | Bible | |
| 2,405,129 | A | 8/1946 | Bible | |
| 4,210,427 | A | 7/1980 | Brett et al. | |
| 4,504,293 | A | 3/1985 | Gillingham et al. | |
| 4,823,731 | A | 4/1989 | Howeth | |
| 4,838,902 | A * | 6/1989 | Lomax | 95/279 |
| 5,066,315 | A | 11/1991 | Haberl et al. | |
| 5,217,512 | A * | 6/1993 | Williams | 96/425 |
| 5,281,246 | A | 1/1994 | Ray et al. | |
| 5,930,994 | A | 8/1999 | Shimato et al. | |
| 5,961,675 | A | 10/1999 | Son et al. | |
| 6,085,382 | A * | 7/2000 | Bobrosky et al. | 15/350 |
| 6,569,218 | B2 | 5/2003 | Dudley | |

(Continued)

FOREIGN PATENT DOCUMENTS

DE 41 38 223 C1 2/1993

(Continued)

*Primary Examiner* — Jason M Greene
*Assistant Examiner* — Karla Hawkins
(74) *Attorney, Agent, or Firm* — Hunton & Williams

(57) ABSTRACT

This invention relates to a vacuum cleaner comprising a body with a vacuum source. The vacuum cleaner is provided with at least two filter chambers, a first filter chamber for a first filter means in a surface cleaning mode and a second chamber for the same or a second filter means in a filter cleaning mode.

24 Claims, 9 Drawing Sheets

U.S. PATENT DOCUMENTS

| | | | | |
|---|---|---|---|---|
| 6,733,574 | B2 | 5/2004 | Gubler | |
| 6,830,599 | B1 | 12/2004 | McCutchen | |
| 2003/0131571 | A1 * | 7/2003 | Demarco | 55/324 |
| 2005/0011036 | A1 | 1/2005 | McCutchen | |
| 2005/0183233 | A1 | 8/2005 | Lin | |

FOREIGN PATENT DOCUMENTS

| | | | |
|---|---|---|---|
| JP | 4-352925 | A | 12/1992 |
| JP | 2002-28107 | A | 1/2002 |
| WO | WO 85/02528 | A1 | 6/1985 |
| WO | WO 90/12532 | A1 | 11/1990 |

* cited by examiner

FILTER CLEANING SYSTEM FOR A VACUUM CLEANER

FIELD OF THE INVENTION

The present invention relates to a vacuum cleaner. More particularly, embodiments of the invention relate to apparatus and methods for cleaning filters used in a vacuum cleaner.

BACKGROUND OF THE INVENTION

Traditional vacuum cleaners usually belong to two different categories called canister cleaners and upright cleaners. The canister vacuum cleaner comprises a housing enclosing an electric fan unit that creates an airflow from a vacuum cleaner nozzle through a tube shaft and a hose and further through a separating system comprising a porous bag collecting the dust before the air reaches the fan and leaves the housing to the ambient air. The upright vacuum cleaner differs from the canister cleaner in that the tube shaft and the hose are eliminated and that the nozzle, that often is provided with a rotating brush, is pivotally connected to the vacuum cleaner housing. The housing encloses the fan unit and the air pervious dust bag and is provided with a handle to move the complete vacuum cleaner on the floor.

In order to further clean the air before the air leaves the vacuum cleaners mentioned above additional filters are arranged after the dust bag as seen in the air flow direction. These filters are usually placed such that they can easily be removed and be replaced by a new filter. As an alternative certain filters might be taken away in order to be cleaned by manual operations or by washing or rinsing the filter in water and/or cleaning agents.

There are also so called cyclone vacuum cleaners on the market, see for instance EP 00850060.1, that are provided with a different type of dust separation system. Instead of using an air pervious collecting bag the dust is separated by means of a vortex created in a circular cyclone chamber. The particles are by means of centrifugal action directed outwards from the centre of the vortex and are collected in a collecting container whereas the cleaned air is taken out from the center of the vortex. The clean air is then sucked to the vacuum source and flows out from the vacuum cleaner to the ambient air. Even if the main part of the dust particles that are present in the dust laden air are separated by the cyclone a minor part of the particles follow the clean airflow out of the cyclone. Consequently also for this type of vacuum cleaners there is a need for filters in the air passages after the cyclone chamber in order to get an efficient cleaning of the air flowing out from the vacuum cleaner.

It is a disadvantage that the operator of all of the vacuum cleaners mentioned above has to remove the filter and replace it or clean it since replacement means that the consumer always has to keep an eye on the consumption of the filter and to buy new filters when necessary whereas cleaning means that the vacuum cleaner can not be used during the washing period and moreover demands for certain cumbersome activities from the operators side.

It has also been proposed, see WO 85/02528, to provide a vacuum cleaner with two electrical motors (FIGS. 1-4) each having a filter that is placed in a common dust collecting chamber. In order to clean the filters the airflow through each filter is reversed by means of the other motor. The same publication also shows a vacuum cleaner arrangement (FIGS. 5-6) that is provided with one motor and one main filter and an auxiliary filter the filters also being placed in a common dust collecting chamber. In order to clean the main filter the airflow is reversed and directed through the auxiliary filter. A clear disadvantage with the first arrangement is the need for two motors whereas there is no indication how to clean the auxiliary filter in the second arrangement.

SUMMARY OF THE INVENTION

A first purpose of this invention is to create an arrangement that eliminates the above drawbacks making it possible for the operator to change a filter quickly and to easily keep track of the filter condition. Another purpose of the invention is to create an arrangement that makes it possible to easily clean the filter without taking the vacuum cleaner out of operation or using cumbersome methods for cleaning the filter.

BRIEF DESCRIPTION OF THE DRAWINGS

The accompanying drawings, which are incorporated in and constitute a part of this specification, illustrate embodiments of the invention and, together with the description, serve to explain the principles of the invention.

In the drawings.

DETAILED DESCRIPTION OF THE PREFERRED EMBODIMENTS

The following description is intended to convey a thorough understanding of the invention by providing a number of specific embodiments and details involving a vacuum cleaner. It is understood, however, that the invention is not limited to these specific embodiments and details, which are exemplary only. It is further understood that one possessing ordinary skill in the art, in light of known systems and methods, would appreciate the use of the invention for its intended purposes and benefits in any number of alternative embodiments.

Embodiments of the invention described herein comprise a canister vacuum. However, the invention is not limited to a canister vacuum, but rather, a person having ordinary skill in the art would recognize that the invention can also be applied to upright vacuums or other apparatus requiring particle separation from an airflow.

Figure 3:
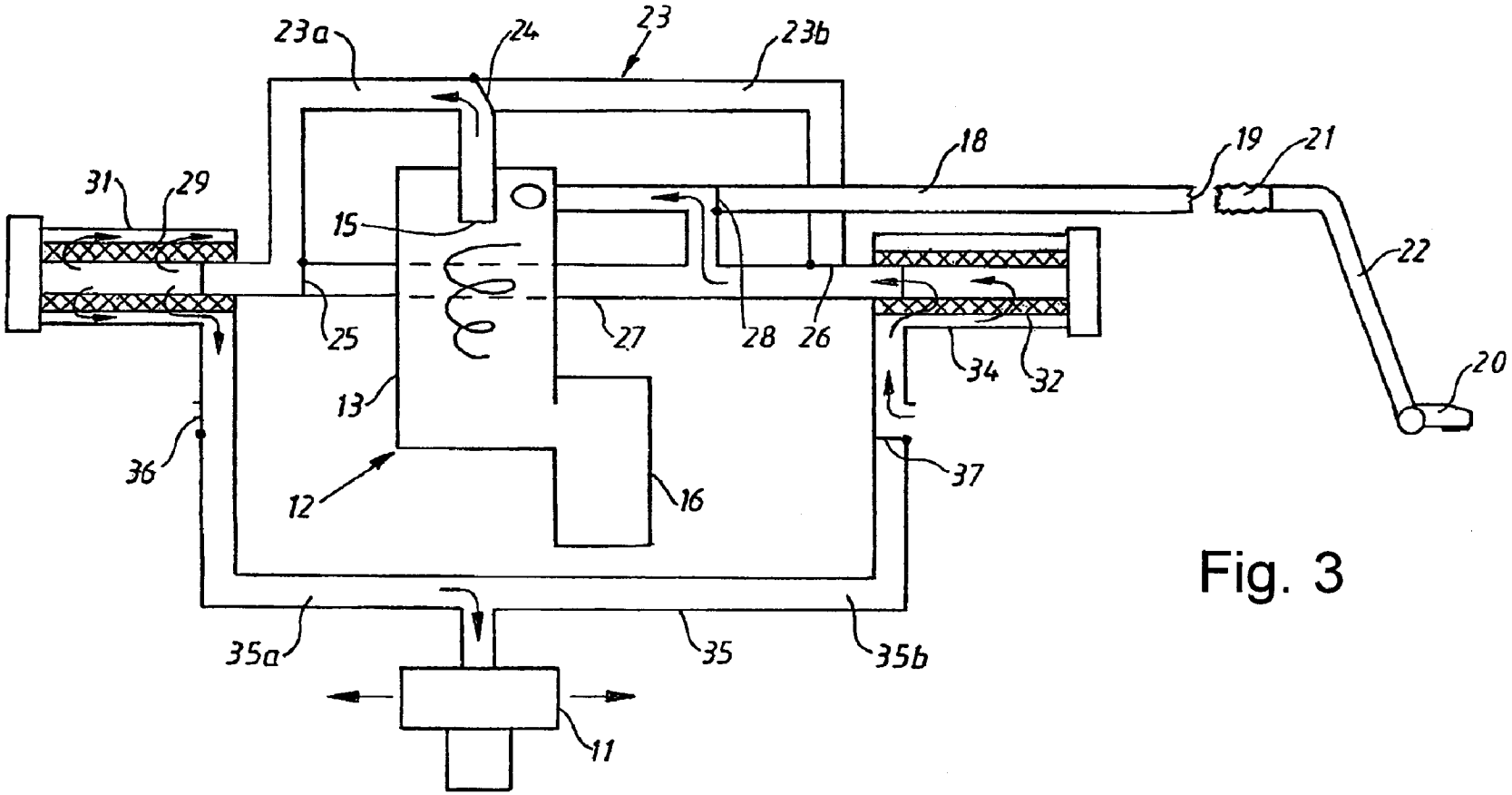
FIG. 3 shows a schematic view of vacuum cleaner comprising a first embodiment of the invention. The schematic shows the airflow through the vacuum cleaner when a first filter is cleaned.
Figure 4:
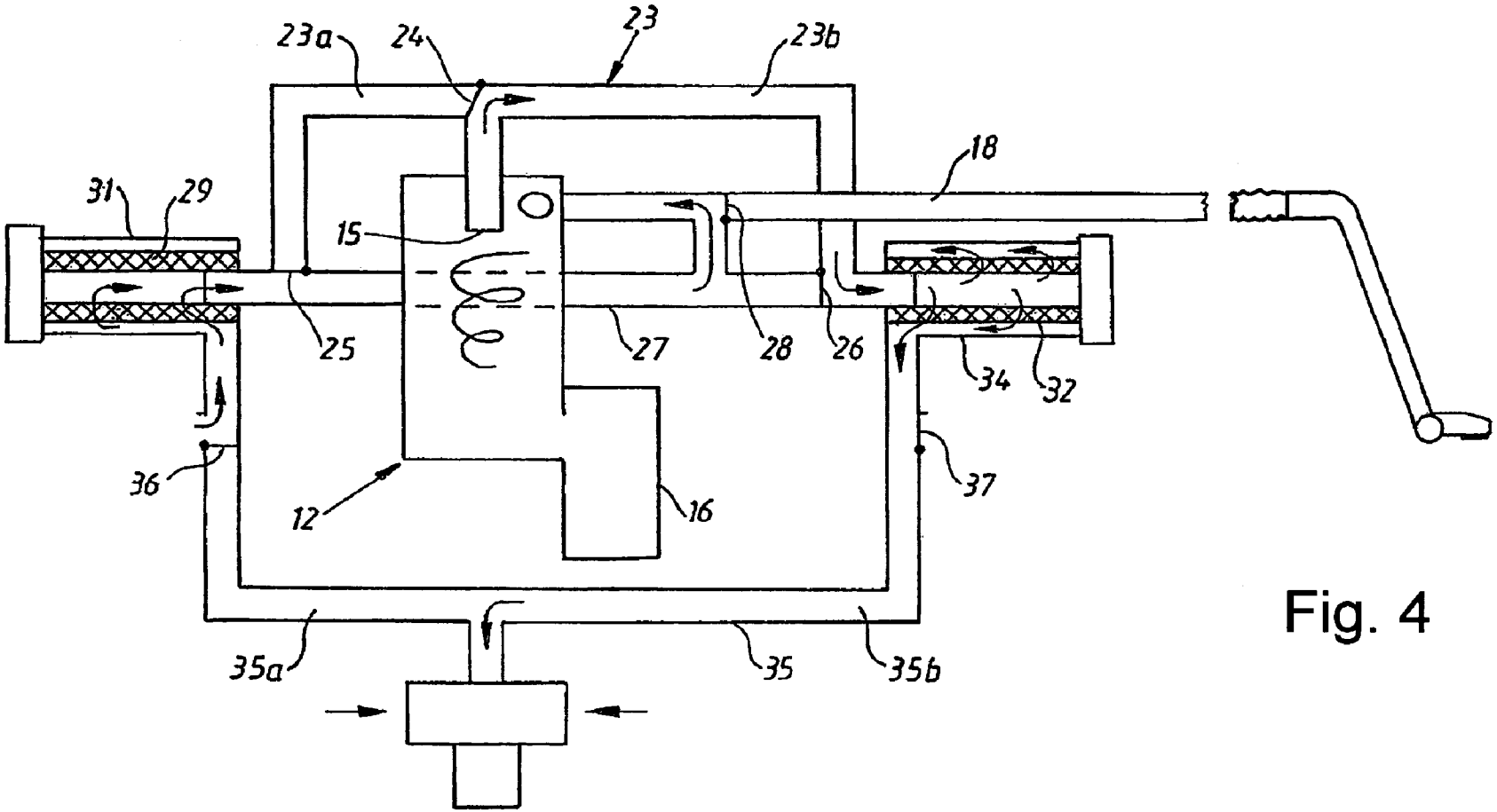
FIG. 4 shows a schematic view of vacuum cleaner comprising a first embodiment of the invention. The schematic shows the airflow through the vacuum cleaner when a second filter is cleaned.
Figure 5:
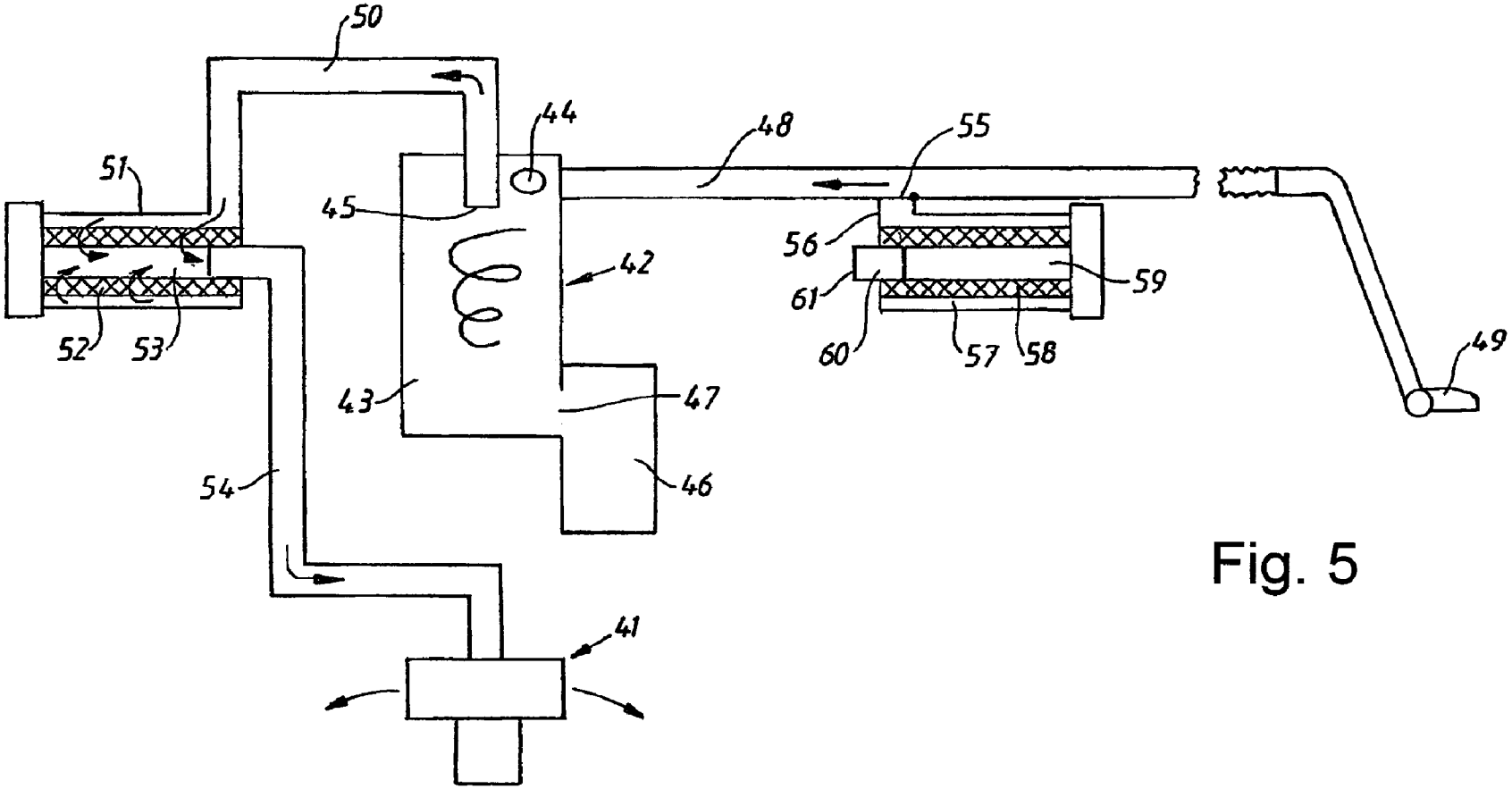
FIG. 5 shows a schematic view of vacuum cleaner comprising a second embodiment of the invention. The schematic shows a first filter in an active position during an ordinary vacuum cleaning operation and a second filter is in an inactive, stored position.
Figure 6:
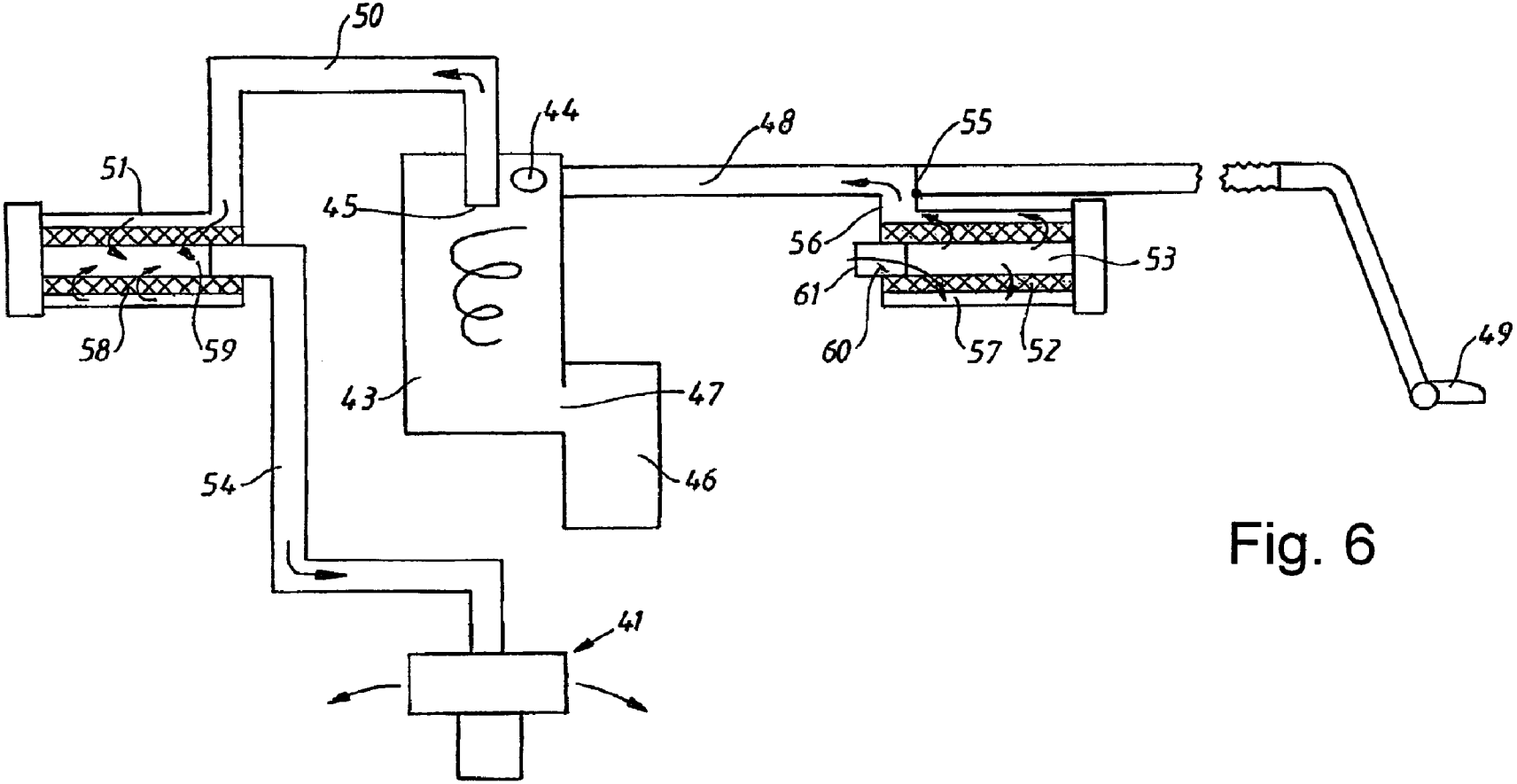
FIG. 6 shows a schematic view of vacuum cleaner comprising a second embodiment of the invention. The schematic shows a filter being cleaned in the stored position.
Figure 7:
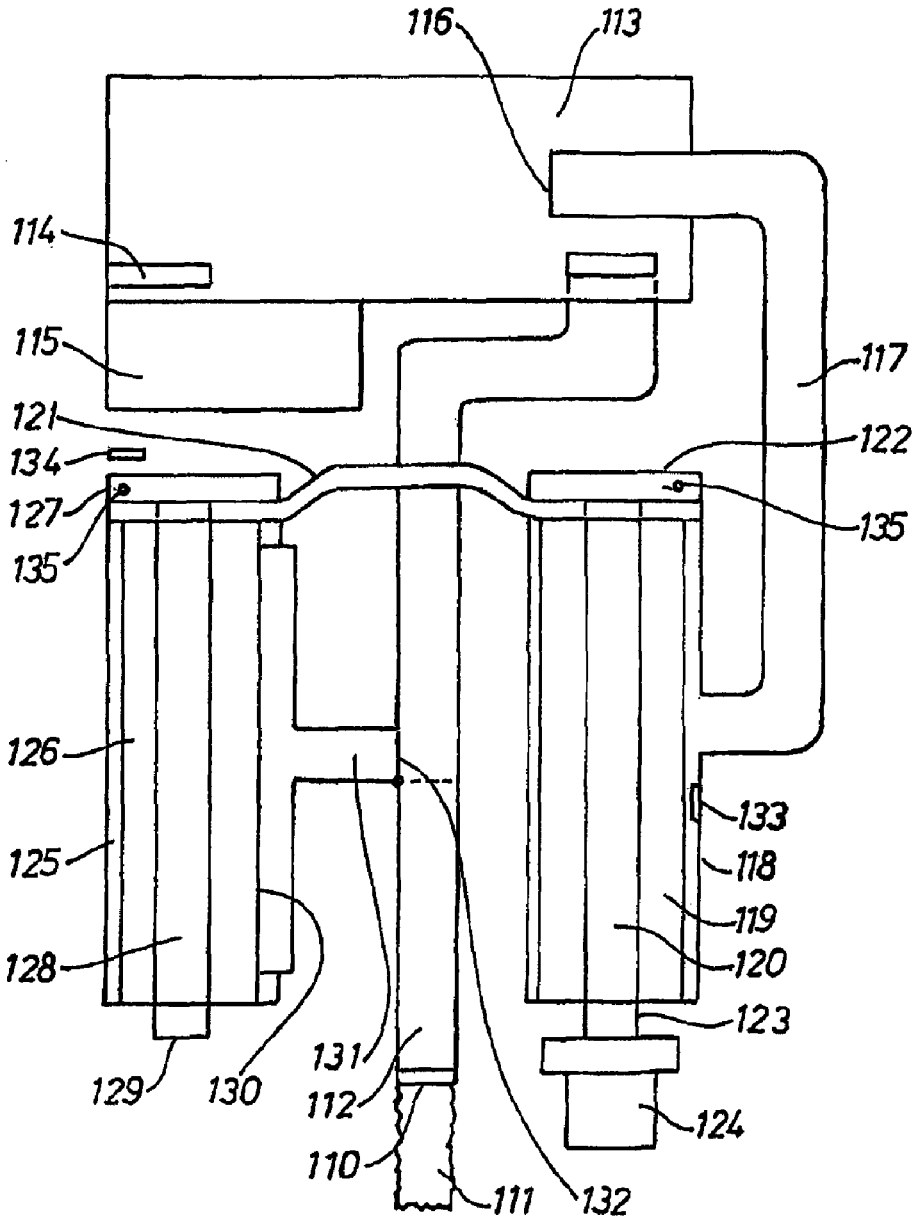
FIG. 7 shows an alternative schematic view of vacuum cleaner comprising an embodiment of the invention.
Figure 8:
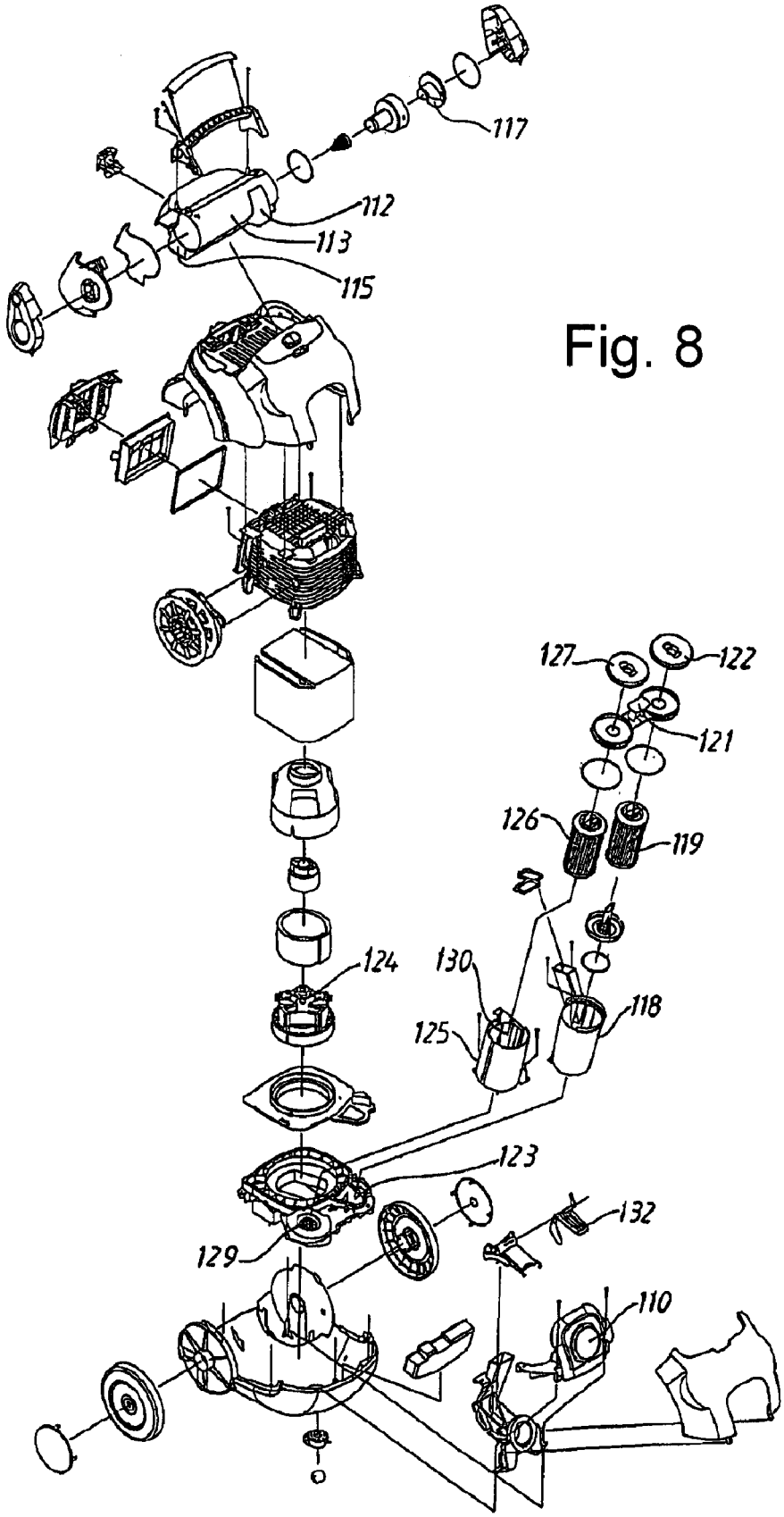
FIG. 8 shows an exploded view of a body of a vacuum cleaner comprising an embodiment of the invention.
Figure 9:
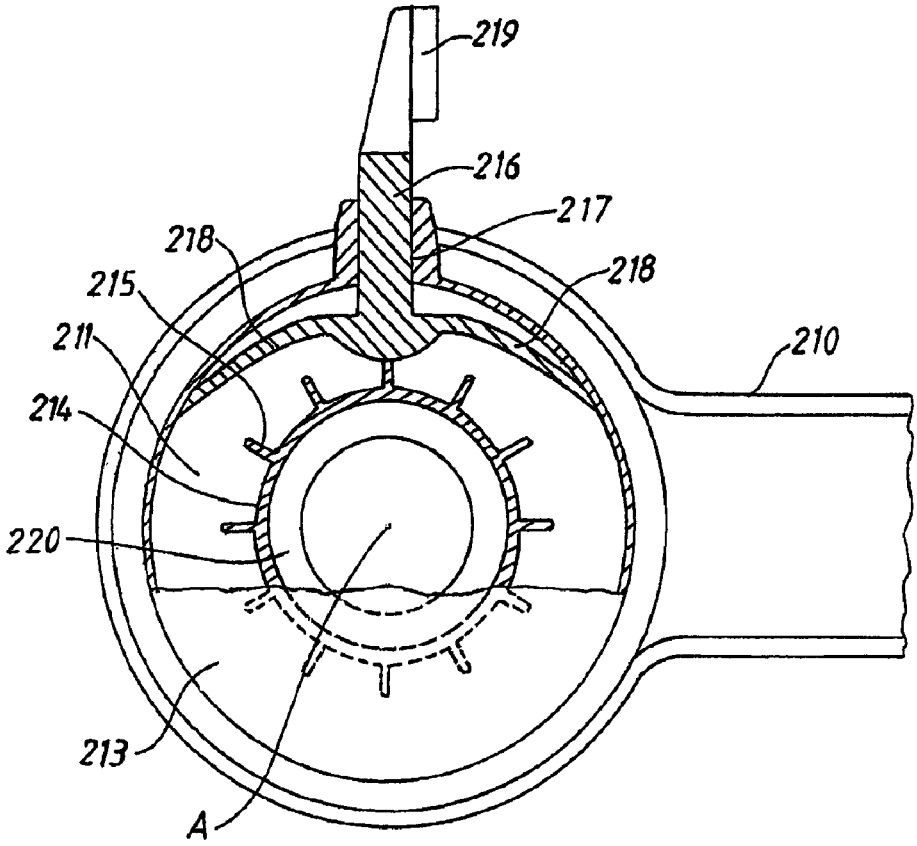
FIG. 9 is a schematic drawing of an embodiment of a filter rotating mechanism.

Three embodiments of the invention will now be described by reference to the accompanying schematic drawings on which FIGS. 1-4 shows the first embodiment of the invention, FIGS. 5 and 6 shows the second embodiment and FIGS. 7 and 8 show the third embodiment whereas FIG. 9 is a schematic drawing of a suitable filter rotating mechanism.

Figure 1:
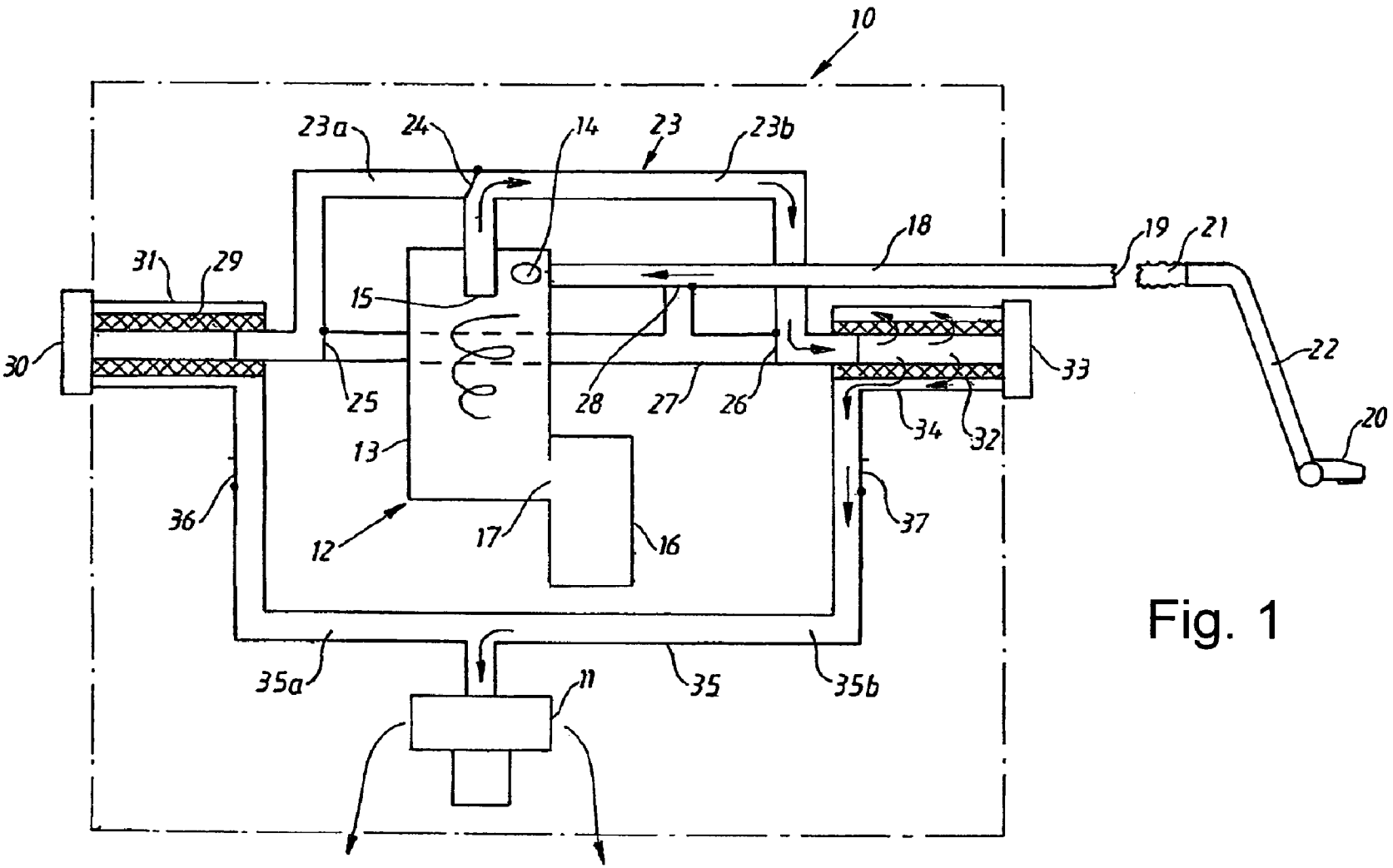
FIG. 1 shows a schematic view of vacuum cleaner comprising a first embodiment of the invention. The schematic shows a first filter in an active position and a second filter is in an inactive position.
Figure 2:
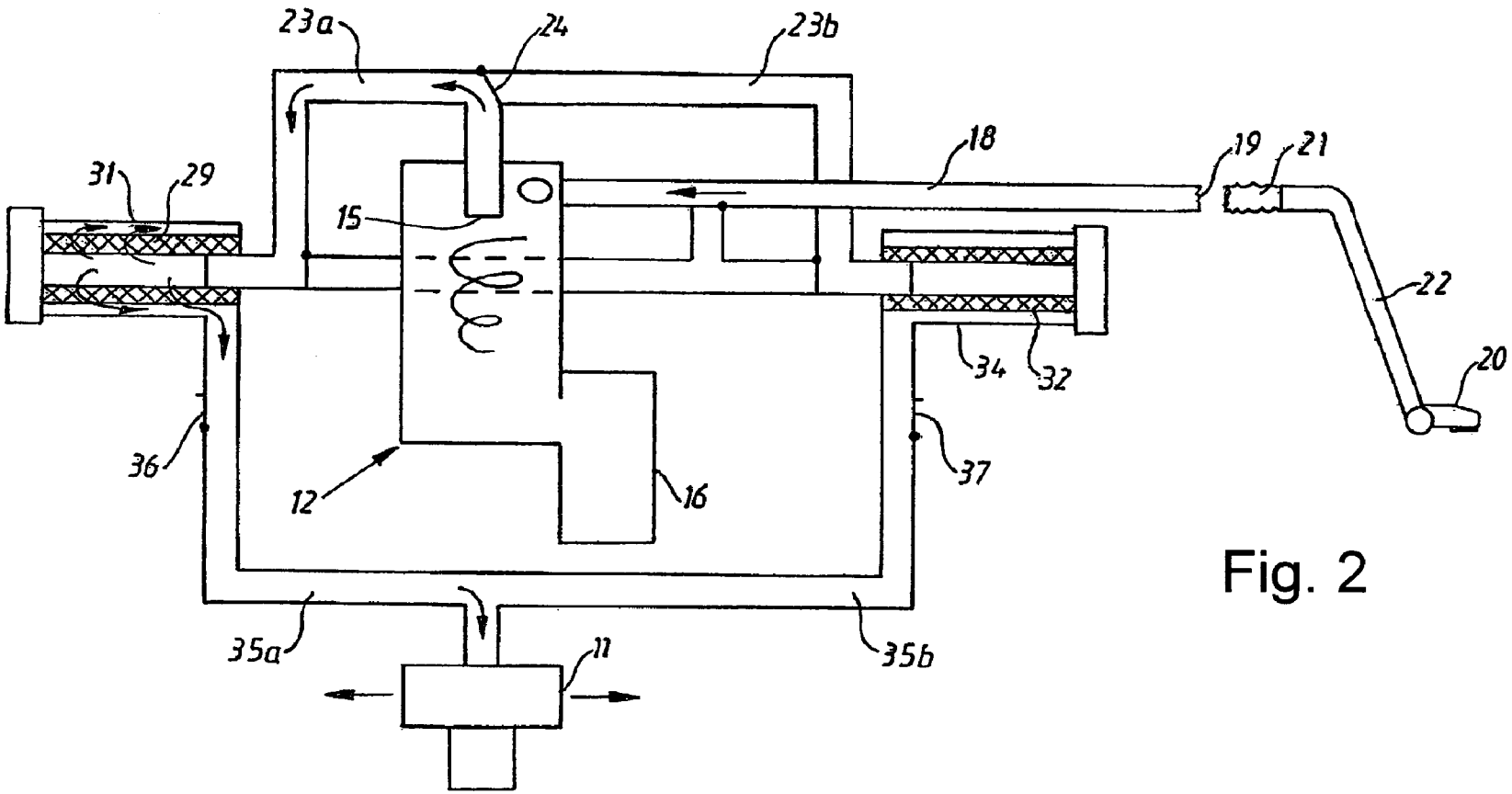
FIG. 2 shows a schematic view of vacuum cleaner comprising a first embodiment of the invention. The schematic shows a first filter in an inactive position and a second filter is in an active position.

The vacuum cleaner shown in FIG. 1 has a first filter in an active position whereas a second filter is in an inactive position during an ordinary cleaning operation. FIG. 2 shows the same view as FIG. 1 but with the first filter in an inactive position and the second filter in an active position. FIG. 3 shows the airflow through the vacuum cleaner when the first filter is cleaned whereas FIG. 4 shows the airflow when the second filter is cleaned. According to the second embodiment FIG. 5 shows a first filter in an active position during an ordinary vacuum cleaning operation at the same time as a second filter is in an inactive stored position whereas FIG. 6 shows a filter being cleaned in the stored position. FIG. 7 is a schematic view of the third embodiment of the filter cleaning system whereas FIG. 8 is an exploded view of a vacuum cleaner that is provided with the last mentioned filter cleaning system.

FIG. 1 schematically shows a vacuum cleaner body 10 that encloses a single vacuum source such as fan unit 11 and a dust separation unit 12. The dust separation unit 12 is of the so called cyclone type and comprises a circular chamber 13 that is provided with a tangential inlet 14 for dust laden air and a central outlet 15 for clean air. Due to the airflow a vortex is created within the chamber 13 and the dust particles are separated from the airflow by means of the centrifugal forces and are thrown into a dust collecting container 16 via an opening 17.

The inlet 14 is via a channel 18 connected to an opening 19 in the vacuum cleaner body that in a conventional way can be connected to a vacuum cleaner nozzle 20 via a hose 21 and a tube shaft 22. The central cyclone outlet 15 is connected to a channel 23 via a valve 24 such that the airflow can be directed to a first or a second section 23*a*, 23*b* of the channel 23. The sections 23*a* and 23*b* are via valves 25 and 26 connected to a common channel 27 that by means of a further valve 28 is branched off from the channel 18.

Channel section 23*a* ends in a the central parts of a first tube shaped filter cartridge 29 that is provided with a grip 30 that is accessible from the outside of the vacuum cleaner. The cartridge 29 is inserted in a first filter space 31, shaped as a filter holder, provided at the vacuum cleaner body and can easily be removed from the space. The filter cartridge 29 is preferably made from a material that can be cleaned manually or by a washing operation.

Channel section 23*b* in a corresponding way ends in the central part of a second tube shaped filter cartridge 32 provided with a grip 33 accessible from the outside of the vacuum cleaner. This cartridge is inserted in a second filter space 34 and has the same design and filter material as the first mentioned cartridge 29.

The first as well as the second filter space 31, 34 offers a free space around each filter cartridge which are connected to a common channel 35 communicating with the fan unit 11. The channel comprises a first and a second section 35*a* and 35*b* each being provided with a valve 36 and 37 that can connect the section with the ambient air.

The arrangement operates in the following manner. During an ordinary cleaning operation, see FIG. 1, the valve 28 is in such a position that the opening to the branched off channel 27 is closed. Dust laden air is taken in through the nozzle 20 and is distributed through the tube shaft 22, the hose 21 and the channel 18 to the cyclone chamber 13. The major part of the dust particles are separated in the cyclone chamber 13 and are distributed to the collecting container 16. The clean air with a minor part of smaller particles flows out through the outlet 15 at the centre of the cyclone chamber 13 and is by means of the valve 24 directed into the second section 23*b* and is by the valve 26 directed further into the central part of the second tubular filter cartridge 32. The air then flows through the filter material in the cartridge, in which the major part of the remaining particles are filtered out, before the air reaches the filter space outside the filter cartridge 32 from which the air flows further into the second section 35*b* of the channel 35 before entering into the fan unit 11. The air then escapes from the vacuum cleaner out to the ambient possibly via an exhaust filter (not shown) that might be of the Hepafilter type. During this procedure the valves 36 and 37 are in such positions that they keep the openings to the ambient air closed.

Assuming that the second filter cartridge 32 gets clogged the operator has the possibility to continue the vacuum cleaning operation, see FIG. 2, simply by changing the airflow direction from the second filter cartridge 32 to the first filter cartridge 29. This is effected by changing the positions of the valve 24 such that the clean air flows from the cyclone outlet 15 through the first section 23*a* of the channel 23 via the valve 25 into the central part of the filter cartridge 29 from which the air flows through the filter material and into the first section 35*a* of the channel before reaching the fan unit 11.

The operator also has the possibility to clean each filter cartridge in a simple manner by switching the airflow direction in the arrangement. FIG. 3 shows how the second filter cartridge 32 is cleaned. Ambient air is allowed to enter into the system by means of the valve 37. This air flows through a part of the channel section 35*b* into the filter space 34 outside the filter cartridge 32 and further through the filter material to the central part of the cartridge. Particles that have been clogged at the inside of the filter cartridge 32 are torn away and are taken up by the airflow and are by means of the valves 26 and 28 distributed through the branched off channel 27 and a part of the channel 18 into the cyclone chamber 13. In order to get sufficient cleaning of the filter there preferably are means, not shown, for concentrating the airflow through the filter to a smaller part of the total filter area such that the air velocity increases through this part. By gradually moving the airflow with respect to the filter surface, for instance by rotating the filter manually or automatically, the complete filter area will be cleaned. From the clean air outlet 15 of the chamber 13 the air then flows through the first section 23*a* of the channel 23 into the interior of the first filter cartridge 29 and through the filter material before leaving the first filter space 31 via the first section 35*a* of the channel 35 to the fan unit 11. During this cleaning procedure the valve 25 keeps the opening between the first section 23*a* and the branched off channel 27 closed and the valve 36 keeps the opening between the first section 35*a* and the ambient air closed.

FIG. 4 shows how the first filter cartridge 29 is cleaned in a corresponding way. The operator activates the various valves such that ambient air is now allowed to enter into the system by means of the valve 36. The air flows, in a similar way that has been described above, through the first filter cartridge 29 and the branched off channel 27 into a part of the channel 18 and further into the cyclone chamber 13. The clean airflow from the outlet 15 in the cyclone chamber 13 is then directed through the second section 23*b* of the channel 23 before entering into the interior of the second filter cartridge 32 where the major part of the remaining particles are separated. After flowing through the filter material the air is directed through the second section 35*b* of the channel 35 and further into the fan unit 11.

Thus, the arrangement described above makes it possible to continue a cleaning operation even if the efficiency decreases due to clogging in the filter by simply directing the airflow from the cyclone to another filter. The arrangement also makes it possible to clean the filters without taking them out of the vacuum cleaner simply by activating or deactivating the different valves such that the airflow is shifted in a suitable way. Since the filter cartridges are easy to remove from the vacuum cleaner body it is also easy for the operator to take away the cartridge and clean it more thoroughly in a washing operation if the cartridges are not fully cleaned in the suction operation described above.

The embodiment shown in FIGS. 5-6 comprises a single vacuum source such as a fan unit 41 and a dust separation unit 42 of the cyclone type having a circular chamber 43 with an inlet 44 for dust laden air and an outlet 45 for partially cleaned air. The separation unit is connected with a dust collecting container 46 via an opening 47 through which the dust particles are distributed into the container. The inlet 44 is in the same manner as described above via a channel 48 connected to a vacuum cleaner nozzle 49. The air outlet 45 of the cyclone is connected to a channel 50 that directs the cleaned air to a first filter space 51 for a first tube shaped filter cartridge 52 that is removably inserted into said space. A central part 53 of the cartridge 52 communicates via a channel 54 with the fan unit 41 such that air is sucked from the central part 53 to the fan and then is directed to the ambient air.

The channel 48 is provided with a valve 55 that allows air to be taken in to the chamber through a branched off channel 56 at the same time as the airflow from the nozzle 49 is prevented from flowing to the inlet 44. The channel 56 is connected to a second filter space 57 of a second removable, tube shaped filter cartridge 58. The central part 59 of the cartridge 58 is connected to a tube 60 provided with an opening 61 through which air can be sucked into the filter cartridge.

The system according to FIGS. 5 and 6 operate in the following manner. During normal vacuum cleaning work (see FIG. 5) dust laden air is sucked into the chamber 43 through the nozzle 49 and the channel 48. During this procedure the valve is in such a position that the connection to the channel 56 is closed. Consequently dirt particles are separated in the chamber 43 and are directed into the dust collecting container 46. The air which now has been partially cleaned is sucked through the outlet 45 and the channel 50 to the filter space 51 from which the air flows through the filter material of the cartridge 52 into the central part 53 of the cartridge. This means that the major part of the particles that have not been separated in the chamber 43 is deposited on the filter material when the air flows through the filter material and further into the channel 54 from which it leaves to the ambient air via the fan unit 41.

When the first cartridge 52 becomes clogged and provided that the second cartridge 58 has been cleaned the operator switches off the vacuum cleaner and exchanges the position of the two cartridges (see FIG. 6) such that it is possible to continue the work but this time with the clean cartridge 58 in the space 51 and the dirty cartridge 52 in the space 57.

If the operator finds it suitable to clean the cartridge 52 which is now in the filter space 57 he activates the valve 55 such that the connection between the channel 56 and the inlet opening 44 is opened at the same time as the connection to the nozzle 49 is closed. This means that ambient air is drawn through the opening 60 into the central part of the cartridge 52 and further through the filter material into the filter space 57. This means that the dust particles on the filter surfaces become free and are transported via the channel 48 to the chamber 43 together with the airflow. The major part of the dust particles are, as mentioned before, separated in the chamber 43 and collected in the container 46 whereas the clean air leaving through the outlet 45 enters the filter space 51 for the cartridge 58 where the air is filtered through the filter material before leaving the vacuum cleaner through the channel 54 and the fan unit 41. It should in this connection be mentioned that in order to get an efficient filter cleaning of the filter cartridge the airflow is concentrated to a small area of the filter surface when the air flows from the inner to the outer side of the filter cartridge.

According to a further embodiment of the invention it is also possible to use the invention in a conventional cyclone vacuum cleaner that is provided with solely one active filter that is easily removable and that is placed in a filter space connected to the air cyclone and the fan unit. Such a vacuum cleaner can be provided with at least one additional non active filter space serving as a storage place for a passive filter which is easily accessible from the outside of the vacuum cleaner. When the active filter has been clogged during a vacuum cleaner operation the operator can easily remove the active filter from the active filter space and replace it with a cleaned filter that is taken out from the additional filter space. The operator can then finish the cleaning operation and also use the vacuum cleaner for additional cleaning operations before removing the clogged filter and wash or clean it manually. When the filter has been cleaned it is again inserted into the additional non active filter space in order to be used when the active filter has been clogged.

The vacuum cleaner according to FIG. 7 and FIG. 8 comprises an inlet opening 110 for dust laden air that in a conventional manner can be connected to a vacuum cleaner nozzle (not shown) via a hose 111. The inlet opening continues as an inlet channel 112 that ends in a mainly cylindrical cyclone chamber 113. The cyclone chamber 113 communicates via an opening 114 with a dust collecting container 115 and has a tube shaped outlet 116 arranged in the central part of the cyclone chamber. This outlet 116 communicates with an air passage 117 ending in a filter chamber 118 in which a first filter cartridge 119 is inserted. The filter cartridge preferably is provided with one or several folded filter layers arranged around a central channel 120 and having its outer periphery placed at some distance from the inner wall of the filter chamber 118. The upper portion of the filter cartridge is turnably and removably arranged at one end of a support structure 121 shaped as a handle.

The support structure 121 is provided with a turnable knob 122 that is connected to the filter cartridge 119 such that the filter cartridge follows the rotating motion of the knob 122 if it is turned manually. The rotating motion of the knob or the filter cartridge might of course also be achieved automatically by an electric motor or some other means. The central channel 120 of the filter cartridge is at its lower part in communication with an air channel 123 connected to the air inlet of a vacuum source such as a motor/fan unit 124 whose outlet communicates with the ambient air.

The vacuum cleaner is also provided with a filter cleaning chamber 125 in which a second filter cartridge 126, preferably of the same type as the first filter cartridge, is inserted. The second filter cartridge 126 is in the same manner as the first filter cartridge 119 removably arranged at the other end of the support structure 121 and is also rotatably connected to a knob 127 secured to the support structure 121. The second filter cartridge has a central channel 128 that is connected to an air inlet 129 arranged at the bottom of the filter cleaning chamber 125 and tha communicates with the ambient air. The filter cleaner chamber is further provided with an outlet 130 that is shaped as an elongated narrow opening extending mainly parallel to the axis of the filter cartridge close to the outer periphery of the cartridge. The outlet 130 is via an air passage 131 and a valve 132 connected to the inlet channel 112 for dust laden air.

The vacuum cleaner is provided with an electric circuit that is connected to a pressure sensor 133 for sensing the pressure drop over the first filter cartridge 119 in order to indicate when the filter has been clogged. When this occurs a bulb or an acoustic signal is activated. There also is a sensor 134 arranged close to, or within, the filter cleaning chamber 125 for achieving a signal to the electric circuit when the filter in the filter cleaning chamber has been cleaned. This sensor is connected to a sensor system that includes a permanent magnet 135 arranged on the periphery of each knob 122, 127 and is connected such that the vacuum cleaner motor starts when the knob 122 is being turned and shuts off when a predetermined complete turns have been made by the operator.

The device operates and is used in the following manner. When the operator starts the vacuum cleaner dust laden air is sucked in through the hose111 and the inlet channel 112 to the cyclone chamber 113. Since the inlet flow is arranged to be tangentially to the mainly cylindrical cyclone chamber 113 a vortex is created and the particles are, due to centrifugal forces, thrown towards the periphery and out through the opening 114 into the dust container where they are collected. The cleaned airflows through the outlet 116 of the cyclone chamber 113 into the air passage 117 and continues into the filter chamber 118 before the air reaches the first filter cartridge 119. Smaller particles that have passed the cyclone chamber are now separated in the filter material and the air then via the central channel 120 flows to the motor/fan unit 124 and is distributed to the ambient air.

When the first filter cartridge has been clogged this is indicated by the light bulb or the acoustic signal via the pressure sensor 133. The operator can now switch off the vacuum cleaner and open a cover at the front part of the vacuum cleaner that is connected to the valve 132 such that the valve closes the outer part of the inlet channel 112 and opens up the connection between the inner part of this channel and the air passage 131. The operator then lifts the support structure 121 to which the first and second cartridge 119, 126 are secured and turns it 180° about a mainly vertical axis before putting the first filter cartridge 119 into the filter cleaning chamber 125 at the same time as the second filter cartridge 126 is inserted in the filter chamber 118.

The operator then manually turns the knob 122 thereby starting to rotate the filter cartridge 119 such that the permanent magnet 135 influences the sensor 134 and creates a signal starting the motor/fan unit 124. This means that fresh air is now sucked in from the ambient air through the air inlet 129 and into the central channel 120 of the cartridge 119. The air then flows through the part of the filter material facing the narrow outlet 130 with great velocity thereby releasing the dust particles that have been taken up previously and carrying them via the passage 131 and the inner part of the inlet channel 112 to the cyclone chamber 113. The major part of the particles are separated and collected in the dust container 115 whereas the cleaned air leaves through the outlet 116 and flows to the filter chamber 118 via the air passage 117.

The air is then sucked through the filter material and remaining particles are taken up by the second filter cartridge 126 before the air leaves to atmosphere via the air channel 123 and the motor/fan unit 124. When the operator has finished a predetermined number of complete turns of the knob 122 the motor/fan unit is stopped indicating that the filter has been cleaned. The operator now closes the cover which means that the valve 132 is moved back to its original position and the operator can again start the vacuum cleaner and continue his work. When the second filter cartridge 126 has been clogged the procedure described above will be repeated thereby switching the two filter cartridges 119, 126 back to their original positions.

As has been mentioned above the rotating motion of the filter cartridge might as well be realized by mechanical and/or electrical means and for instance be arranged such that the fan and the rotation starts automatically when the dirty filter has been inserted into the filter cleaning chamber.

A plan view of a preferable filter rotating mechanism is shown in FIG. 9 Such a mechanism is arranged at each end of an elongated filter support structure 210 for two cylindrical filters (only one half is shown). Each end of the filter support structure comprises a mainly circular bottom plate 211 with an upwardly extending flange 212 on which a rotatable cup shaped cover 213 is arranged. The cover is provided with an annular element 214 having a number of several outwardly extending fins 215. During rotation of the cover 213 the fins will come into engagement with a slider 216 that is linearly movable in an opening 217 in the flange 212. The part of the slider 216 that is below the cover is provided with two resilient tongues 218 that rest against the flange 212 and consequently push the slider towards the rotation axis A of the cover 213. The part of the slider that is placed outside the opening 217 is arranged such that it can act against a micro switch 219 connected to the electrical system of the vacuum cleaner. A filter cartridge 220 is placed below the bottom plate 211 and is removably secured to the cover 213 such that it follows the rotation of the cover. The filter cartridge is mainly cylindrical and has a folded outer surface with the folding lines parallel to said axis A.

The rotating mechanism operates in the following manner. When a filter has been used and it is time to shift the clogged filter from the filter chamber to the cleaning chamber the support structure with the two filters are turned 180° and the filters are then inserted in their new positions. The operator starts to turn the cover 213 which means that the slider 216 is moved back and forth by the fins 215 and acts on the switch 219 thereby establishing electrical pulses that can be counted by the electric equipment within the vacuum cleaner. After a few pulses the fan is arranged to start. Simultaneously the folds of the filter are successively passing the elongated, narrow, outlet opening in the cleaning chamber such that air can be drawn from the inlet opening in the cleaning chamber through the lower central inlet opening of the filter cartridge, through the filter material and into said outlet opening. After a predetermined number of complete turns and the corresponding amount of pulses the motor of the fan is fan is shut off by the electric system.

In order to make the dust removal even more efficient it is possible to provide the walls of the cleaning chamber with ridges or similar elements such that dust is wiped off the folds when passing the ridges during the rotation of the filter.

The invention claimed is:

1. A vacuum cleaner comprising:

a nozzle configured to be traversed on a surface to be cleaned, the nozzle having an internal passage defined by a nozzle inlet positioned to be substantially adjacent the surface to be cleaned and a nozzle outlet remote from the nozzle inlet;

a vacuum source configured to generate a working air flow, the working air flow passing through the vacuum cleaner along an air flow path;

a separation system configured to separate particles from the working air flow, the separation system comprising a first filter chamber;

a filter cleaning system comprising a second filter chamber having a second filter chamber inlet and a second filter chamber outlet, the second filter chamber outlet being shaped as an elongated slot;

a first dirt filter configured to be alternatively placed in the first filter chamber and the second filter chamber; and wherein:

the elongated slot is positioned adjacent a relatively small portion of a total surface area of the filter and extends along substantially an entire length of the first dirt filter, the first dirt filter is configured to be movable relative to the slot when the first dirt filter is placed in the second filter chamber to thereby incrementally expose substantially the total surface area of the filter to the slot, and the air flow path comprises switching means for switching between a surface cleaning mode in which the working air flow enters the nozzle inlet and passes through the first filter chamber to entrap dirt particles in the first dirt filter when the first dirt filter is located in the first filter chamber, and a filter cleaning mode in which the working air flow passes through the second filter chamber to displace dirt particles from the first dirt filter when the first dirt filter is located in the second filter chamber.

2. The vacuum cleaner of claim 1, wherein the working air flow does not pass through the second filter chamber when the air flow path is in the surface cleaning mode.

3. The vacuum cleaner of claim 1, wherein the working air flow does not pass through the first filter chamber when the air flow path is in the filter cleaning mode.

4. The vacuum cleaner of claim 1, wherein the working air flow passes through the first dirt filter in a first direction when the air flow path is in the surface cleaning mode, and the working air flow passes through the first dirt filter in a second direction when the air flow path is in the filter cleaning mode, the second direction being generally opposite the first direction.

5. The vacuum cleaner of claim 1, wherein the separation system further comprises a cyclone separator configured to remove dirt from the working airflow, and wherein the air flow path passes through the cyclone chamber to remove dirt from the working air flow when the air flow path is in the surface cleaning mode.

6. The vacuum cleaner of claim 5, wherein the cyclone separator is located upstream of the first filter chamber when the air flow path is in the surface cleaning mode.

7. The vacuum cleaner of claim 1, wherein the separation system further comprises a cyclone separator configured to remove dirt from the working airflow, and wherein the air flow path passes through the cyclone chamber to remove dirt from the working air flow when the air flow path is in the filter cleaning mode.

8. The vacuum cleaner of claim 7, wherein the cyclone separator is located downstream of the second filter chamber when the air flow path is in the filter cleaning mode.

9. The vacuum cleaner of claim 1, further comprising an ambient air inlet, wherein the second filter chamber is located downstream of the ambient air inlet when the air flow path is in the filter cleaning mode.

10. The vacuum cleaner of claim 1, further comprising a valve configured to switch the vacuum cleaner between the surface cleaning mode and the filter cleaning mode.

11. The vacuum cleaner of claim 1, further comprising a second dirt filter, the second dirt filter being configured to be alternatively placed in the first filter chamber when the first dirt filter is in the second filter chamber, and in the second filter chamber when the first dirt filter is in the first filter chamber.

12. The vacuum cleaner of claim 11, further comprising a support structure having a first end attached to the first dirt filter, and a second end attached to the second dirt filter, the support structure further being removable from the vacuum cleaner with the first dirt filter and second dirt filter attached thereto.

13. The vacuum cleaner of claim 12, wherein the first filter chamber is adjacent the second filter chamber, and the support structure overbridges a distance between the first filter chamber and the second filter chamber, and the support structure can be manipulated to position the first dirt filter in the first filter chamber and the second dirt filter in the second filter chamber, or to position the first dirt filter in the second filter chamber and the second dirt filter in the first filter chamber.

14. The vacuum cleaner of claim 1, wherein the first dirt filter is movable when placed in the second filter chamber, and movement of the first dirt filter activates the vacuum source to cause the working air flow to move through the vacuum cleaner when the air flow path is in the filter cleaning mode.

15. The vacuum cleaner of claim 14, wherein the filter comprises a filter cartridge having a cylindrical profile, the filter cartridge being rotatable about a longitudinal axis thereof.

16. The vacuum cleaner of claim 1, wherein:

the first dirt filter comprises a filter cartridge having a cylindrical profile; and the slot is positioned proximal to an outer periphery of the filter cartridge and extends substantially parallel to a longitudinal axis of the filter cartridge.

17. A vacuum cleaner comprising:

a vacuum source configured to generate a working air flow;

an inlet nozzle configured to be traversed on a surface to be cleaned;

a dirt separation system comprising a first filter chamber having a first filter chamber inlet and a first filter chamber outlet;

a filter cleaning system comprising a second filter chamber having a second filter chamber inlet and a second filter chamber outlet;

a clean air outlet;

a filter configured to be selectively and alternatively positioned in the first filter chamber and the second filter chamber, and having a surface configured to hold dirt particles; and an air flow system comprising:

a surface cleaning air flow path extending from the inlet nozzle to the first filter chamber inlet, from the first filter chamber inlet through the filter surface in a first direction when the filter is positioned in the first filter chamber and to the first filter chamber outlet, through the vacuum source, and then to the clean air outlet; and a filter cleaning air flow path extending from an ambient air inlet to the second filter chamber inlet, from the second filter chamber inlet through the filter surface in a second direction when the filter is positioned in the second filter chamber and to the second filter chamber outlet, the second direction being generally opposite the first direction, through the vacuum source, and then to the clean air outlet;

wherein the second filter chamber outlet comprises an elongated slot positioned adjacent a relatively small portion of a total surface area of the filter and extending along substantially the entire length of the filter when the filter is positioned in the second filter chamber, and the filter is movable within the second filter chamber to incrementally expose the total surface area of the filter to elongated slot.

18. The vacuum cleaner of claim 17, in which the air flow system further comprising a valve configured to selectively choose one or the other of the surface cleaning air flow path and the filter cleaning air flow path.

19. The vacuum cleaner of claim 17, wherein the dirt separation system comprises a cyclone separator fluidly connected between the inlet nozzle and the first filter chamber in the surface cleaning air flow path, and fluidly connected between the second filter chamber and the clean air outlet in the filter cleaning air flow path.

20. The vacuum cleaner of claim 17, further comprising a second filter configured to be positioned in the first filter chamber when the filter is in the second filter chamber, and in the second filter chamber when the filter is in the first filter chamber.

21. A vacuum cleaner comprising:

an inlet configured to receive a first flow of air;

a particle separator configured to separate particles from the first flow of air;

a first filter chamber positioned downstream from the particle separator and configured to receive the first flow of air;

a filter cleaning chamber configured to receive a second flow of air;

a vacuum source configured to generate the first flow of air and the second flow of air; and a removable first filter configured to be positioned in the first filter chamber during normal operation to receive the first flow of air in a first direction therethrough, and further configured to be removed from the first filter chamber and inserted into the filter cleaning chamber to receive the second flow of air in a second direction therethrough to thereby clean the first filter;

wherein the filter cleaning chamber comprises an air outlet in fluid communication with the vacuum source, the air outlet being positioned adjacent a relatively small portion of a total surface area of the filter and comprising an elongated slot that extends along substantially an entire length of the first filter; and wherein the first filter is mounted within the filter cleaning chamber by a movable mount that permits the first filter to be moved generally transverse to the elongated slot to thereby incrementally position the total surface area of the filter adjacent the elongated slot.

22. The vacuum cleaner of claim 21, further comprising a removable second filter, wherein the first filter and the second filter can be interchanged between the first filter chamber and the filter cleaning chamber for alternatively cleaning the first filter and the second filter.

23. A vacuum cleaner comprising:

a filter having a dirt-receiving side configured to block the flow of particles therethrough;

a first filter chamber comprising a first filter chamber inlet, a first filter chamber outlet, and a first filter chamber filter receptacle configured to selectively hold the filter fluidly between the first filter chamber inlet and the first filter chamber outlet, with the dirt-receiving side facing the first filter chamber inlet;

a second filter chamber comprising a second filter chamber inlet, a second filter chamber outlet, and a second filter chamber filter receptacle configured to selectively hold the filter fluidly between the second filter chamber inlet and the second filter chamber outlet, with the dirt-receiving side facing the second filter chamber outlet;

a vacuum source configured to generate a first flow of air from the first filter chamber inlet to the first filter chamber outlet, and a second flow of air from the second filter chamber inlet to the second filter chamber outlet;

wherein the second filter chamber outlet is positioned adjacent a relatively small portion of a total surface area of the filter and comprises an elongated slot positioned adjacent the filter and extending along substantially an entire length of the filter, and the filter is movable within the second filter chamber to incrementally expose the total surface area of the filter to elongated slot.

24. The vacuum cleaner of claim 23, further comprising a cyclone separator, the cyclone separator being selectively and alternatively fluidly connectable to the first filter chamber inlet and the second filter chamber outlet.

* * * * *